United States Patent [19]

Nalepka

[11] 4,269,880

[45] May 26, 1981

[54] DISPOSABLE SELF-PLEATING DRAPES AND METHOD FOR MAKING SAME

[76] Inventor: Debra A. Nalepka, 25 Woodland Dr., Avon, Conn. 06001

[21] Appl. No.: 869,166

[22] Filed: Jan. 13, 1978

[51] Int. Cl.[3] ..... A47H 23/08

[52] U.S. Cl. ..... 428/43; 112/427; 160/348; 160/395; 160/398; 428/57; 428/83; 428/99; 428/100; 428/103; 428/104; 428/121; 428/181; 428/286

[58] Field of Search ..... 428/57, 83, 99, 100, 428/103, 104, 121, 181, 43, 286; 160/348, 395, 398; 112/427

[56] References Cited

U.S. PATENT DOCUMENTS

| | | | |
|---|---|---|---|
| 320,245 | 6/1885 | Hamm . | |
| 2,799,774 | 7/1957 | Levine | 160/348 X |
| 2,985,235 | 5/1961 | Landell | 160/348 |
| 3,011,174 | 12/1961 | Schaerer | 428/181 X |
| 3,279,530 | 10/1966 | Romano et al. | 160/348 |
| 3,529,652 | 9/1970 | Warner | 160/348 |
| 3,633,251 | 1/1972 | Gass | 160/348 X |
| 3,791,436 | 2/1974 | Weckbrodt | 160/348 |
| 3,851,760 | 12/1974 | Smith . | |
| 4,054,703 | 10/1977 | Boehn | 428/57 X |
| 4,117,180 | 9/1978 | De Woskin | 160/348 X |

*Primary Examiner*—Marion McCamish
*Attorney, Agent, or Firm*—McCormick, Paulding & Huber

[57] ABSTRACT

A disposable self-pleating drape comprises an elongated sheet of expendable material. A pleating strip extends along an upper marginal portion of the sheet and is connected in face-to-face relation to the sheet at a longitudinally series of pleating locations. At least two prong receiving openings are formed between the pleating strip and the sheet at each pleating location and are spaced apart a distance substantially greater than the distance between corresponding parallel prongs on an associated drapery hook used to hang the drape. A continuous form assembly of series connected disposable self-pleating drapes is made by continuously advancing an elongated web of disposable material, folding a longitudinally extending marginal portion of the advancing web in overlying relation with another portion of the web, and connecting the marginal portion in face-to-face relation with the other portion of the web at a longitudinal series of pleating locations to form at least two prong receiving pockets at each pleating location.

18 Claims, 11 Drawing Figures

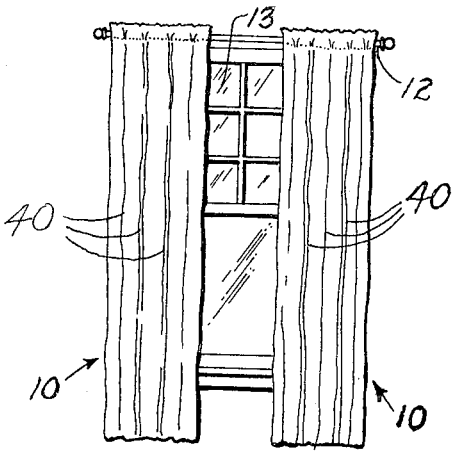
Fig. 1
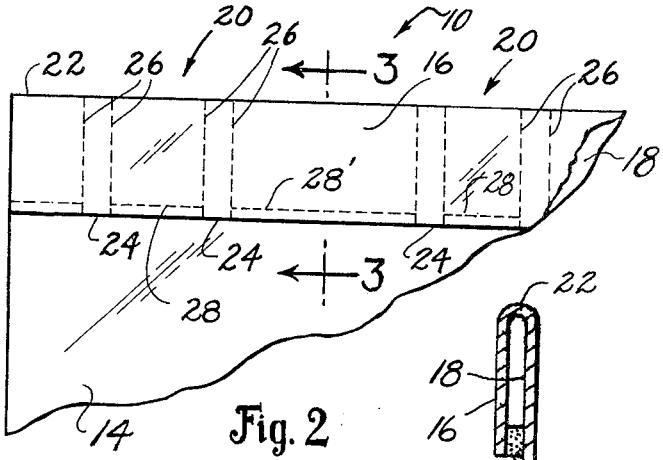
Fig. 2
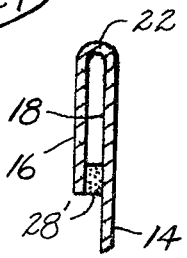
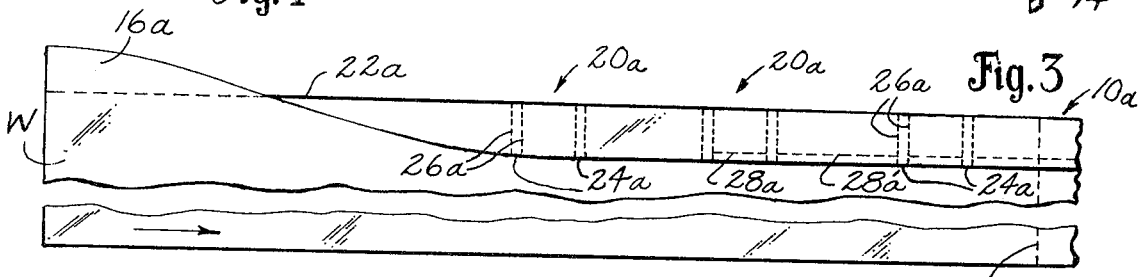
Fig. 3
Fig. 4
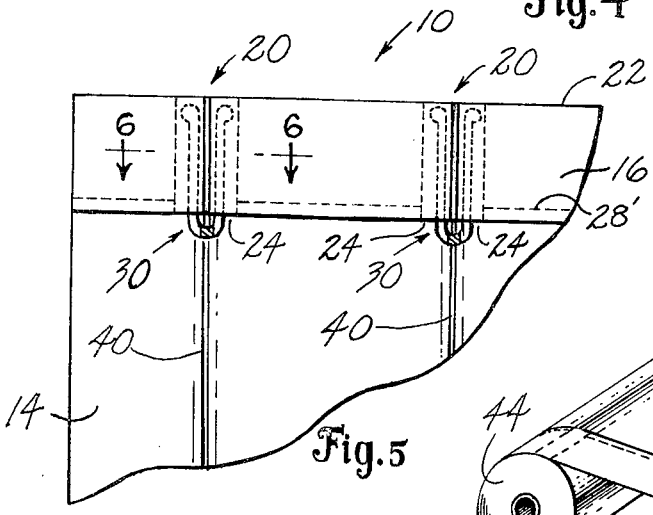
Fig. 5
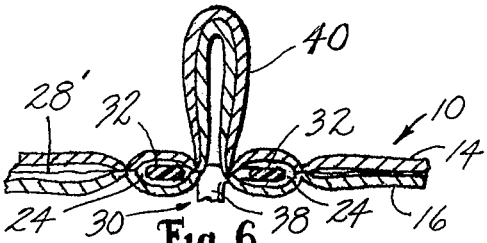
Fig. 6
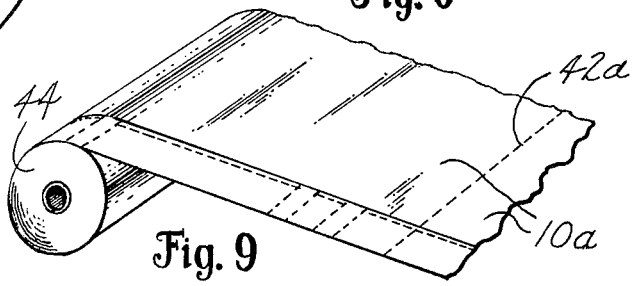
Fig. 9
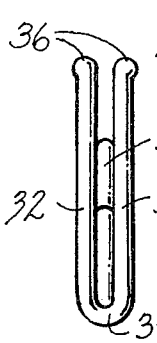
Fig. 7
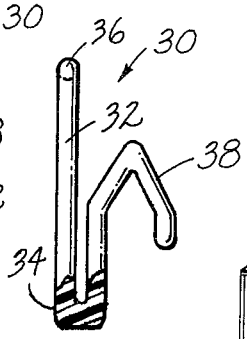
Fig. 8
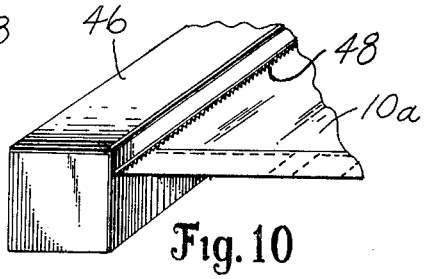
Fig. 10
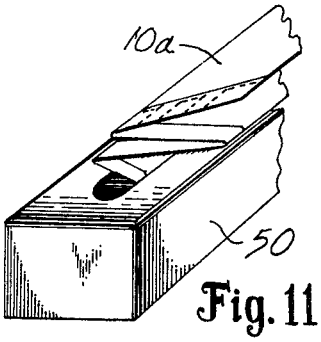
Fig. 11

DISPOSABLE SELF-PLEATING DRAPES AND METHOD FOR MAKING SAME

BACKGROUND OF THE INVENTION

This invention relates in general to window drapes and the like and deals more particularly with improved disposable drapes which are self-pleating, the pleats being automatically formed when the drapes are hung.

Purchasers of new homes are frequently faced with the problem of providing temporary coverage for windows, glass doors, transparent partition walls and the like until appropriate curtains or drapes can be obtained. If custom made drapes are required there may be considerable delay before such drapes can be obtained. A similar problem may be encountered by the occupant of any building when existing drapes for the building are taken down for cleaning and processing. Further, the rigid sanitation requirements of hospitals and like facilities further create a need for improved disposable drapes which are attractive and yet may be thrown away after a relatively short period of use at negligible loss. It is the general aim of the present invention to provide improved expendable drapes which generally satisfy these requirements.

SUMMARY OF THE INVENTION

In accordance with the present invention an improved disposable self-pleating drape comprises a sheet of disposable material, a pleating strip, and means connecting the pleating strip in face-to-face relation to an upper marginal portion of the sheet at a plurality of pleating locations. The pleating strip cooperates with the sheet and the connecting means to define at least two longitudinally spaced prong receiving openings at each pleating location. The prong receiving openings are spaced apart a distance greater than the distance between corresponding parallel prongs on an associated drapery hook, so that when the hook is inserted into the prong receiving openings a pleat is automatically formed in the drape. A continuous form assembly of series-connected drapes is made by advancing an elongated web of disposable material in the direction of its longitudinal axis, folding a longitudinally extending marginal portion of the advancing web inwardly along a longitudinally extending fold line, and connecting the marginal portion in face-to-face relation to an associated underlying portion of the advancing web at a plurality of pleating locations to form at least two prong receiving openings at each location between the marginal portion and the associated underlying portion. Lines of weakening may be formed on the web to define lines of separation between the ends of adjacent drapes in the series.

BRIEF DESCRIPTION OF THE DRAWING

FIG. 1 is a front elevational view of a pair of disposable self-pleating window drapes embodying the invention and shown hung in front of a window.

FIG. 2 is a somewhat enlarged fragmentary rear elevational view of one of the drapes of FIG. 1, but shows the drape before it is hung.

FIG. 3 is a fragmentary sectional view taken along the line 3—3 of FIG. 2.

FIG. 4 is a somewhat schematic fragmentary plan view and illustrates successive steps in a process for making a continuous form assembly of series connected drapes in accordance with the present invention.

FIG. 5 is a somewhat enlarged fragmentary rear elevational view of one of the drapes of FIG. 1 and shows the drape with draper hooks assembled therewith.

FIG. 6 is a somewhat enlarged fragmentary sectional view taken along the line 6—6 of FIG. 5.

FIG. 7 is a front elevational view of a typical drapery hook used in practicing the invention.

FIG. 8 is a side elevational view of the drapery hook of FIG. 7.

FIG. 9 is a fragmentary perspective view of a continuous form assembly of drapes embodying the invention and packaged in roll form.

FIG. 10 is a fragmentary perspective view and shows a package for dispensing individual drapes from a continuous form assembly of drapes.

FIG. 11 is a fragmentary perspective view and illustrates another package for dispensing individual drapes from a continuous form assembly of drapes in accordance with the invention.

DETAILED DESCRIPTION OF THE PREFERRED EMBODIMENT AND METHOD

Turning now to the drawing, and referring particularly to FIG. 1, a pair of window drapes embodying the invention includes identical drapes, indicated generally at 10, 10, shown hung on a conventional drapery rod 12 and in front of a window 13. The drapes 10, 10, which are intended for temporary usage, are made from an inexpensive expendable material and may be thrown away after use at negligible loss. Further, the drapes 10, 10 are self-pleating, the pleats being formed when drapery hooks are assembled with the drapes and the drapes are hung on a drapery rod, as will be hereinafter discussed.

Drapes made in accordance with the present invention are hung on conventional drapery hooks which have at least two spaced parallel prongs. A typical drape 10, illustrated in FIG. 2 and for use with a two-prong drapery hook, is formed from an elongated sheet of expendable material indicated at 14, which forms the body of the drape. The drape 10 further includes an elongated pleating strip 16 which extends along an upper marginal portion of the sheet 14. The pleating strip 16 overlies an associated upper marginal portion indicated at 18 and is connected in face-to-face relation with the sheet 14 at a longitudinally spaced series of pleating locations, indicated generally at 20, 20, as will be hereinafter further described. The sheet 14 and the pleating strip 16 may be made from separate pieces of material, but preferably, and as shown, the drape 10 is formed from a single piece of plastic or non-woven fabric, the sheet 14 and the pleating strip 16 being connected together along a common fold line 22 which defines the upper marginal edge of the drape 10.

The pleating strip 16 and the upper marginal portion 18 are connected together in face-to-face relation at pleating locations 20, 20 to define at least two longitudinally spaced apart prong receiving openings or pockets 24, 24 at each pleating location. The pockets 24, 24 open toward the lower edge of the sheet 14. More specifically, the pleating strip 16 is connected in face-to-face relation with the associated upper marginal portion 18 along a series of longitudinally spaced and transversely extending lines of attachment 26, 26 which preferably extend across the entire width of the pleating strip 16, substantially as shown in FIG. 2. Each prong receiving pocket 24 is defined by a pair of adjacent lines of connection 26, 26, portions of the sheet 14 and the strip 16 between the latter lines of connection, and by an associated portion of the fold line 22. At this point it should be noted that the longitudinal spacing between the prong receiving pockets 24, 24 at each pleating location 20 is substantially greater than the distance between the prongs of an associated drapery hook to be used to hang the drape 10.

Preferably, and as shown, the pleating strip 16 is further connected in face-to-face relation to the upper marginal portion 18 along longitudinally extending lines of attachment 28, 28' which are transversely spaced from the fold line 22 and which extend between adjacent prong receiving pockets 24, 24. The lines of connection 28, 28' are preferably disposed generally adjacent the lower edge of the pleating strip 16, as best shown in FIG. 2.

A typical drapery hook of the type used to hang a drape 10 is shown in FIGS. 7 and 8, and indicated generally by the reference numeral 30. The illustrated hook 30 comprises a unitary structure molded from plastic material and has two parallel prongs 32, 32 connected together by a U-bend portion 34. Each prong 32 has a smooth rounded free upper end portion 36. A downwardly opening U-shaped clip portion 38, which is integrally connected to the U-bend portion 34 and projects rearwardly therefrom and in a direction normal to the plane of the prongs, serves to support the hook 30 on the conventional drapery rod, such as the rod 12, shown in FIG. 1.

Preparatory to hanging the drape 10, drapery hooks such as the hook 30 are connected to the drape at each pleating location 20. More specifically, each of the two prongs 32, 32 is inserted upwardly into an associated one of the two prong receiving pockets 24, 24. Since the prong receiving pockets 24, 24 are spaced apart a distance substantially greater than the distance between the prongs 32, 32, insertion of the prongs into the pockets cause the pockets to be drawn together in closely spaced relation whereby a pleat is formed in the drape 10 at each pleating location 20, as best shown in FIGS. 5 and 6, the pleats being indicated at 40, 40. After each of the hooks has been assembled with the drape, the drape is hung in a conventional manner on an associated drapery rod, such as the rod 12 shown in FIG. 1.

Drapes **10*a* made in accordance with a preferred method of the present invention are marketed in continuous form or series-connected relation to be separated from each other at time of use. Referring now to FIG. 4, successive steps in a process for making a continuous form assembly of series connected drapes, indicated generally at 40, are illustrated somewhat schematically. In accordance with the presently preferred method, an elongated web W of disposable sheet material, which may, for example, comprise plastic or paper with suitable designs imprinted or embossed thereon is continuously advanced in the direction of its longitudinal axis. As the web W is advanced a longitudinally extending marginal portion 16*a* is folded inwardly along a longitudinally extending fold line 22*a* and into face-to-face relation with an associated underlying portion of the web adjacent the fold line 22*a*. The marginal portion 16*a*, which comprises a pleating strip is connected in face-to-face relation with the associated underlying portion of the web W at a series of pleating locations indicated generally at 20*a*, 20*a*. More specifically, the marginal portion 16*a* is joined to the associated underlying portion of the web W along a longitudinally series of transversely extending lines of attachment 26*a*, 26*a* to form a longitudinally spaced series of sets of prong receiving openings 24*a*, 24*a*. The prong receiving openings or pockets 24*a*, 24*a* open toward the longitudinally extending edge of the web W opposite the fold line 22*a*. At least two longitudinally spaced prong receiving openings 24*a*, 24*a* are formed at each pleating location 20*a***.

Since the illustrated web W is preferably made from plastic material, the lines of attachment **26*a*, 26*a* are formed by a heat sealing process. It is for this reason that in FIG. 4 the step of folding the marginal portion or pleating strip 16*a* is shown to have been completed before the step of connecting the pleating strip 16*a* to the associated underlying portion of the web. However, if the assembly is made from another material, such as paper, and the connected portions of the web may be joined by strips of adhesive which will be applied to either the pleating strip or the associated underlying portion of the web to define the various lines of attachment 26*a*, 26*a*** before the step of folding the pleating strip is performed.

In accordance with the illustrated method, the pleating strip **16*a* is joined to the associated portion of the web W, which it overlies, along longitudinally spaced and transversely extending lines of attachment 26*a*, 26*a*, which extend in a transverse direction between the fold line 22*a* and the free edge of the pleating strip 16*a*, substantially as shown, so that at least two prong receiving pockets 24*a*, 24*a* are formed at each pleating location 20*a*. As the web W continues to advance the pleating strip 16*a* is further attached to the associated underlying portion along a series of lines of attachment 28*a*, 28*a*' which extend in a longitudinal direction between the various prong receiving pockets 24*a*, 24*a* substantially as shown in FIG. 4. The lines of attachment 28, 28' are preferably disposed in closely adjacent relation to the free edge of the pleating strip 16*a*** and serve to attach the latter free edge portion of the pleating strip in face-to-face relation with the associated underlying portion of the web W.

The completed continuous form assembly 40, which may be of indeterminate length, comprises a longitudinal series of drapes **10*a*, 10*a* which are connected together in series and in end-to-end relation. However, if desired, a longitudinally spaced series of transversely extending lines of weakening, such as indicated at 42 in FIG. 4, may be formed on the web W to delineate the ends of the various series connected drapes which comprise the continuous form assembly 40. The lines of weakening 42 facilitate separation of the drapes 10*a*, 10*a*** into convenient lengths at time of use.

FIGS. 9–11 illustrate methods for packaging a continuous form assembly of drapes 40 in accordance with the present invention. In FIG. 9 the drape assembly 40 is shown packaged in a roll 44 which may be formed upon completion of the manufacturing process described with reference to FIG. 4. FIG. 10 shows an assembly of series connected drapes **10*a* preferably formed in a roll and packaged within a carton 46 which has a serrated tear-off bar 48 to facilitate dispensing of drapes in strips of desired length. Series connected drapes dispensed in this manner would not have lines of weakening thereon, such as indicated at 42 in FIG. 9, since the tear-off bar 48** facilitates separation of the drapes from each other.

FIG. 11 illustrates an accordion folded package 50 of continuous form drapes 10*a*, 10*a*. The package 50 facilitates convenient dispensing. A continuous form drapery assembly packaged in this manner may or may not have lines of weakening thereon to facilitate separation of drapes from each other. If such lines of separation are omitted, drapes may be cut from the assembly to desired length by the user.

I claim:

1. A disposable self-pleating drape for use with a plurality of drapery hooks each having at least two spaced parallel prongs, said drape comprising a single piece of disposable material including a sheet defining the body of the drape, an elongated pleating strip having an upper edge integrally connected to the upper edge of said sheet along a common fold line defining the upper edge of said drape and extending along a longitudinally disposed upper marginal portion of the sheet in overlying relation therewith, and means connecting said pleating strip in direct face-to-face relation to said upper marginal portion of said sheet along longitudinally spaced and transversely extending lines of attachment to define prong receiving pockets at a longitudinally spaced series of pleating locations, said connecting means cooperating with said pleating strip and said upper marginal portion at each of said pleating locations to define at least two longitudinally spaced prong receiving pockets defining prong receiving openings between the lower edge of said pleating strip and associated position of said sheet, said prong receiving openings at each of said pleating locations being longitudinally spaced apart a distance substantially greater than the distance between the two spaced parallel prongs of an associated drapery hook.

2. A disposable self-pleating drape as set forth in claim 1 including means for connecting said strip to said sheet along longitudinally extending lines of attachment transversely spaced from said upper edge of said pleating strip and extending between adjacent prong receiving pockets.

3. A disposable self-pleating drape as set forth in claim 1 wherein the longitudinal extent of said drape is defined by two longitudinally spaced apart lines of weakening formed on said sheet and said strip and extending transversely thereacross.

4. A disposable self-pleating drape as set forth in claim 1 wherein said sheet and said strip are made from plastic material and said connecting means comprises heat sealing means.

5. A disposable self-pleating drape as set forth in claim 1 wherein said sheet and said strip are made from non-woven fabric and said connecting means comprises adhesive.

6. A disposable self-pleating drape as set forth in claim 1 wherein the longitudinal spacing between adjacent pleating locations is substantially greater than the longitudinal spacing between said two prong receiving pockets comprising said pleating location.

7. Continuous form disposable self-pleating drapes for use with drapery hooks having at least two spaced parallel prongs and comprising a single piece of disposable material including an elongated sheet defining the body of said drapes, an elongated pleating strip having an upper edge integrally connected to the upper edge of said sheet along a common fold line defining the upper of said drape and extending along a longitudinally disposed upper marginal portion of sheet in overlying relation therewith, means connecting said pleating strip in direct face-to-face relation to said upper marginal portion of said sheet along longitudinally spaced and transversely extending lines of attachment at a longitudinally spaced series of pleating locations, said connecting means cooperating with said pleating strip and said upper marginal portion at each of said pleating locations to define at least two longitudinally spaced prong receiving pockets defining prong receiving openings between the lower marginal edge of said pleating strip and an associated portion of said sheet, said prong receiving openings at each of said pleating locations being longitudinally spaced apart a distance substantially greater than the distance between the two spaced parallel prongs of an associated drapery hook to be received therein, and means connecting said strip to said sheet along longitudinally extending lines of attachment transversely spaced from said common fold line and extending between adjacent prong receiving pockets, said sheet and said pleating strip connected thereto defining a longitudinal series of drapes and additional means connecting said drapes in said series in end-to-end relation.

8. Continuous form disposable self-pleating drapes as set forth in claim 7 wherein said additional connecting means comprises a longitudinally spaced series of lines of weakening formed on said sheet and said pleating strip and extening transversely thereacross, each of said drapes being connected to the next successive drape in said series along an associated one of said lines of weakening.

9. A disposable self-pleating drape for use with a plurality of drapery hooks each having at least two spaced parallel prongs, said drape comprising a sheet of disposable material defining the body of said drape, an elongated pleating strip extending along a longitudinally disposed upper marginal portion of the sheet in overlying direct relation therewith, and means connecting said pleating strip in direct face-to-face relation to said upper marginal portion along longitudinally spaced and transversely extending lines of attachment to define prong receiving pockets between said sheet and said strip at a longitudinally spaced series of pleating locations, said connecting means cooperating with said pleating strip and said upper marginal portion at each of said pleating locations to define at least two longitudinally spaced and transversely extending prong receiving pockets defining prong receiving openings between the lower edge of said pleating strip and associated position of said sheet, said prong receiving openings at each of said pleating locations being longitudinally spaced apart a distance substantially greater than the distance between the two spaced parallel prongs of an associated drapery hook.

10. A disposable self-pleating drape as set forth in claim 9 including means for connecting the upper edge of said pleating strip to said sheet.

11. A disposable self-pleating drape as set forth in claim 9 including means for connecting the upper marginal portion of said strip to the upper marginal portion of said sheet and means for connecting the lower marginal portion of said strip to said sheet along longitudinally disposed lines of attachment extending between said transversely extending lines of attachment defining adjacent prong receiving pockets.

12. A disposable self-pleating drape as set forth in claim 11 wherein the longitudinal spacing between adjacent pleating locations is substantially greater than the longitudinal spacing between said two prong receiving pockets comprising said pleating location.

13. A disposable self-pleating drape as set forth in claim 9 wherein said pleating strip is made from the same material as said sheet.

14. A method for making disposable, continuous form, self-pleating, drapes for use with drapery hooks having at least two spaced parallel prongs and comprising the steps of continuously advancing an elongated web of material in the direction of its longitudinal axis, folding a longitudinally extending marginal portion of the advancing web inwardly along a longitudinally extending fold line and into direct face-to-face relation with an associated underlying marginal part of the remainder of the web, and connecting longitudinally spaced parts of said marginal portion to associated portions of said underlying marginal part of said advancing web to form a longitudinal series of connected drape bodies and a two ply marginal pleating strip defined in part by said drape bodies and having a longitudinally spaced series of sets of transversely extending prong receiving pockets which open in the direction of the edge of said web opposite said fold line, each set including at least two prong receiving pockets longitudinally spaced apart a distance substantially greater than the spacing between the two spaced parallel prongs.

15. A method for making disposable, continuous form, self-pleating, drapes as set forth in claim 14 including the additional step of forming a longitudinally spaced series of transversely extending lines of weakening on said advancing web to define a longitudinal series of connected drapes, each drape being connected to the next successive drape in said series along and associated one of said lines of weakening.

16. A method for making disposable, continuous form, self-pleating, drapes as set forth in claim 14 including the additional step of forming the web into a roll, said additional step to be performed after the step of connecting said marginal portion.

17. A method for making disposable, continuous form, self-pleating, drapes as set forth in claim 14 including the additional step of forming said web into an accordion pleated stack, said additional step to be performed after the step of connecting said marginal portion.

18. A method for making disposable, continuous form, self-pleating drapes as set forth in claim 14 including the additional step of attaching parts of said marginal portion to said associated underlying portion along lines of attachment spaced from said fold line and extending between adjacent prong receiving pockets.

* * * * *